United States Patent [19]

Neuendorf

[11] 4,342,214

[45] Aug. 3, 1982

[54] PILOT ASSEMBLY FOR PROGRESSIVE DIE MACHINES

[76] Inventor: J. R. Neuendorf, c/o Modern Die Systems, P.O. Box 445, Elwood, Ind. 46036

[21] Appl. No.: 159,874

[22] Filed: Jun. 16, 1980

[51] Int. Cl.[3] ..... B21D 11/22

[52] U.S. Cl. ..... 72/404; 72/461; 83/228; 267/137; 408/79

[58] Field of Search ..... 72/404, 333, 335, 327, 72/461; 83/228, 61; 267/64.11, 64.15, 137, 130; 408/79

[56] References Cited

U.S. PATENT DOCUMENTS

| | | | |
|---|---|---|---|
| 2,268,856 | 1/1942 | Cummings | 164/29 |
| 3,000,249 | 9/1961 | Foskett | 83/249 |
| 3,338,084 | 8/1967 | Stegman | 72/333 |
| 3,981,060 | 9/1976 | Alling | 29/148.04 C |
| 4,024,593 | 5/1977 | Pendell | 10/86 R |
| 4,088,005 | 5/1978 | Starr | 72/404 |
| 4,114,218 | 9/1978 | Pendell | 10/86 R |
| 4,153,237 | 5/1979 | Supalla | 267/64.15 |

FOREIGN PATENT DOCUMENTS

| | | | |
|---|---|---|---|
| 747581 | 7/1980 | U.S.S.R. | 72/333 |

*Primary Examiner*—Gene Crosby

*Attorney, Agent, or Firm*—Jenkins, Coffey, Hyland, Badger & Conard

[57] ABSTRACT

A pilot assembly as for locating a workpiece in successive forming stages of a machine, such as a punch press, where the workpiece is progressively moved through the forming stages of the machine. The pilot assembly includes a pilot pin mounted to a movable die member of the machine for guiding entry into a previously formed hole in a workpiece or in a companion die member as the die members are moved toward each other, the pin being axially retractable in its mounting in the event it strikes an obstruction. The retraction movement of the pin is controlled by a hydraulic mechanism which includes a hydraulic chamber formed behind the pin into which the pin moves to displace a hydraulic fluid therefrom, a relief chamber communicating with the hydraulic chamber through interconnecting passageways, a first valve closing against flow of hydraulic fluid from the hydraulic chamber to the relief chamber to prevent displacement of fluid therefrom and thereby oppose pin retraction in normal operation, a second valve in parallel with the first valve for returning hydraulic fluid displaced by the retraction of the pin into the hydraulic chamber, and a pressurized compressible gas contained in the relief chamber to return the displaced hydraulic fluid therefrom to the hydraulic chamber and thereby to drive the pilot pin to its normal position when retraction force is removed from the pin.

13 Claims, 4 Drawing Figures

PILOT ASSEMBLY FOR PROGRESSIVE DIE MACHINES

Figure 1:
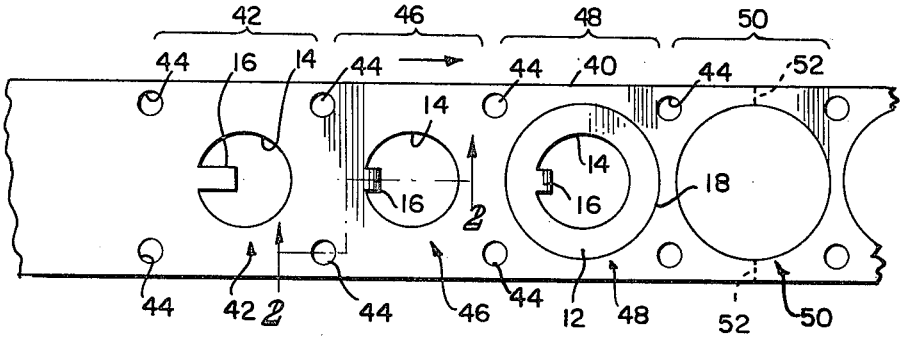

The present invention relates generally to means for mounting pilot pins in machines such as progressive die machines which include movable press elements supporting a plurality of dies and/or punches for performing successive stages of work on a workpiece such as a strip of sheet metal as the sheet metal is fed through the machines, and which include pilot pins for engaging pilot holes formed in the sheet metal to properly locate the sheet metal within each forming stage of the machine. Most particularly, the present invention relates to an improved assembly for supporting a pilot pin in a press element which is fluid-operated to provide control of movement of the pilot pin relative to the press element when a force opposed to movement of the press element is applied to the pilot pin.

Various progressive die machines and methods for forming workpieces from a strip of sheet metal in successive forming stages by progressively feeding the sheet metal through the die machine and locating the sheet metal within each forming stage of the machine are well known in the art. Furthermore, it is well known that locator or pilot pins can be used for engaging pilot holes formed in the sheet metal to properly locate the sheet metal within each forming stage of the die machine.

Typically, the locator or pilot pins are supported by a movable die member of the machine and are moved simultaneously with the die member as it forms the workpiece to engage the pilot holes in the sheet metal. The locator pins assure that the die member will engage the sheet metal in proper orientation. One of the problems associated with these systems and their operation is that if the sheet metal is not properly aligned within the machine, or some other obstruction is present, the locator pin may not engage the pilot hole but instead engages a solid surface, thereby creating a force on the pilot pin which is opposed to the movement of the movable die member. Unless the locator pin is capable of collapsing or retracting in response to this opposed force, serious damage can occur to the locator pin and/or the die machine.

Spring-biased locator pins which are capable of retracting or collapsing in response to forces opposed to the movement of a carriage supporting the locator pin are known in the art. However, such spring-biased locator pins react slowly to opposed forces and become increasingly more difficult to retract as the spring is compressed.

It is therefore one object of the present invention to provide an improved assembly which is fluid-controlled for supporting a pilot pin, which solidly supports the pin for normal operation, but will allow relatively quick retraction of the locator pin in response to excess force opposed to its movement with the press element or die member in which it is mounted and which will oppose such pin retraction by a force which does not progressively increase.

According to the present invention, a pilot mechanism for sensing the proper condition of a workpiece in a machine having a first element movable toward and away from a second element in operations on a workpiece disposed therebetween includes a pilot pin mounted in the first element and having a normal projected position from which it is retractable when a force opposed to the movement of the element is applied to the pin, a hydraulic chamber from which hydraulic fluid is displaced in response to the retraction movement of the pin, and means for maintaining the hydraulic fluid in the hydraulic chamber to oppose the retraction movement until an excessive force is applied to the pin and thereafter for releasing the hydraulic fluid from the chamber in response to the excessive force. The hydraulic fluid is displaced into a receiving chamber which includes a compressible gas sufficiently pressurized to return the displaced hydraulic fluid to the hydraulic chamber when the excessive force is removed.

In a preferred embodiment, an assembly for locating a workpiece in successive forming stages of a progressive die machine includes a movable die member or other carriage, a locator pin for engaging pilot holes formed in the workpiece in response to movement of the carriage, and hydraulic means for supporting the locator pin in the carriage under normal working conditions but which allows retraction movement of the locator pin relative to the carriage when excess force is applied to the locator pin in opposition to the movement of the carriage.

Further according to the present invention, the hydraulic means for supporting the locator pin includes a hydraulic chamber containing a hydraulic fluid to normally oppose movement of the locator pin relative to the carriage, a receiving chamber containing a compressible gas, means for interconnecting the hydraulic and receiving chambers to allow hydraulic fluid to flow therebetween and valve means cooperating with the interconnecting means to allow the hydraulic fluid to flow into the receiving chamber when the force applied to the locator pin in opposition to the movement of the carriage is excessive and to allow a displaced quantity of the hydraulic fluid to flow back into the hydraulic chamber when the force applied to the locator pin decreases.

A method of controlling retraction movement of a normally projected locator pin in a progressive die machine in response to opposition to its normal movement for engaging pilot holes in a workpiece comprises the steps of opposing retraction movement of the locator pin by means of hydraulic fluid contained in a chamber, displacing hydraulic fluid from the hydraulic chamber when the pilot pin exerts sufficient pressure on the hydraulic fluid to open a first normally closed valve and allow the locator pin to retract in response to a force applied to the locator pin in opposition to its normal movement, containing the displaced hydraulic fluid in a receiving chamber, and returning the displaced hydraulic fluid to the hydraulic chamber by applying sufficient pressure to the displaced hydraulic fluid in the receiving chamber to open a second normally closed valve and allow the locator pin to return to its normal projected position when the force opposed to the normal movement of the locator pin decreases.

Figure 1A:
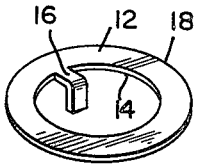
Figure 2:
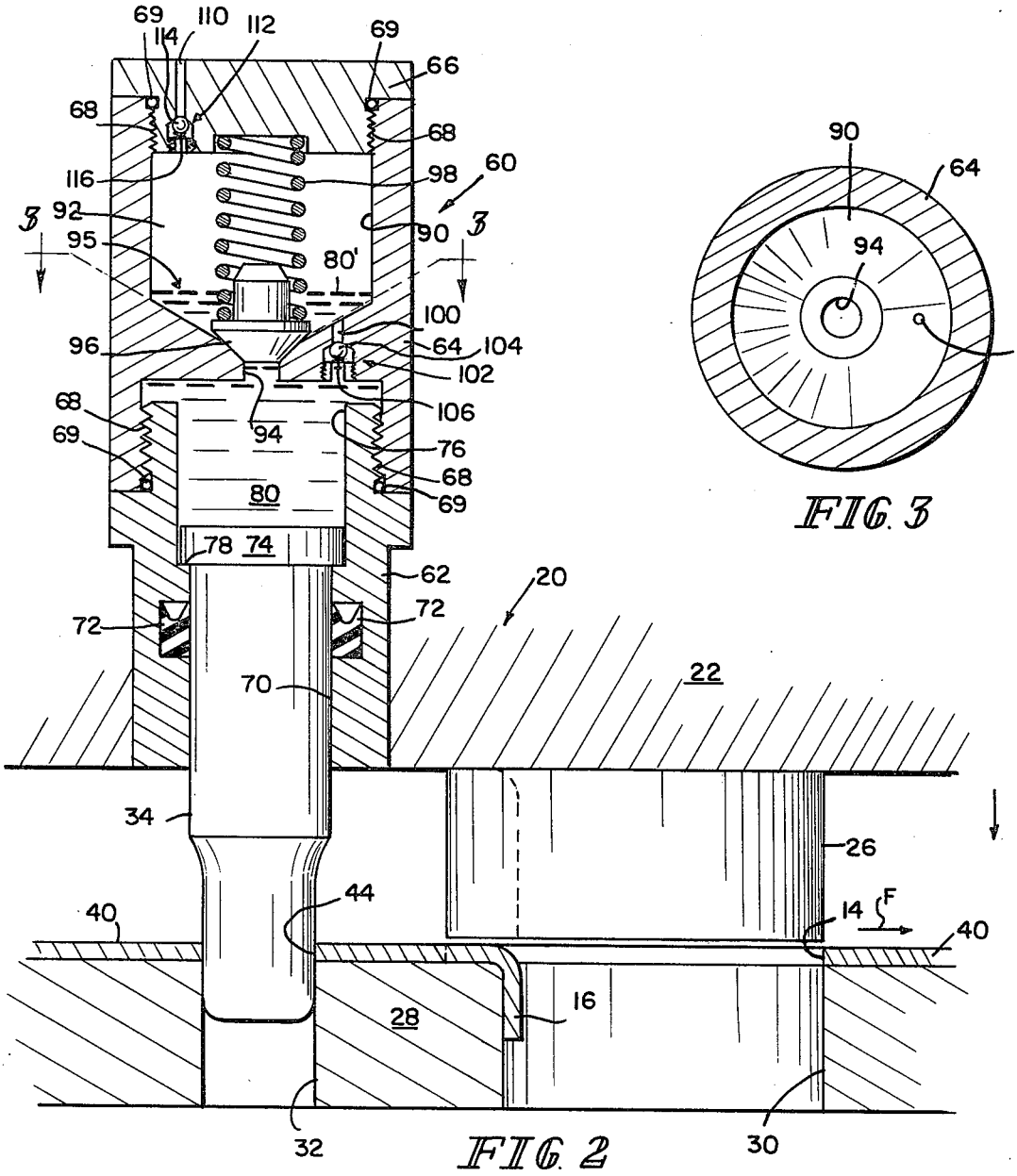
Figure 3:
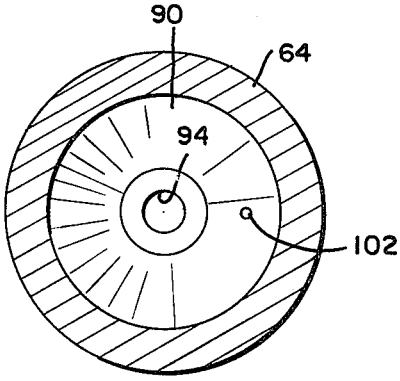

Various other features and advantages of the present invention will become apparent in view of the following detailed description of one embodiment thereof, which description should be considered in conjunction with the drawings, in which:

FIG. 1 is a diagrammatic view representing successive forming stages of a progressive die machine;

FIG. 1*a* is a perspective view of a product of the operations illustrated in FIG. 1;

FIG. 2 is a transverse view, partly cross-sectioned, of a pilot pin assembly according to the present invention which is diagrammatically shown in combination with a progressive die machine and taken generally along section lines 2—2 of a forming stage in FIG. 1; and FIG. 3 is a cross-sectional view of the pilot assembly according to the present invention taken generally along section lines 3—3 of FIG. 2;

Shown in FIG. 1 is a diagrammatic representation 10 of four successive stages for progressively forming a workpiece 12 which, in the illustrative embodiment and as shown in FIG. 1*a*, is a circular washer having a central circular opening 14, a radially inwardly extending tongue 16 which is bent so that a portion thereof projects axially outward, and an outer circular periphery 18. It should be noted that various other workpieces can be progressively formed in successive stages and further that the number of successive forming stages are not necessarily limited to the specific number shown in FIG. 1.

Shown in FIG. 2 is a partially diagrammatic representation of a progressive die machine 20 such as, for example, a punch press. It should be understood that the machine 20 could also be any one of a variety of other commercially available progressive die machines. The die machine 20 comprises a movable upper die member or element 22 having one or more dies or punches 26 attached thereto. The die machine 20 further includes a lower stationary die member or element 28 which includes openings 30 provided in corresponding locations for receiving the punches 26 as the upper die member 22 is moved downward in the direction of the arrow, as viewed in FIG. 2, to form the workpiece 12. The lower die member 28 also provides openings 32 for receiving a locator pin 34 which is carried and supported by the upper die member 22 and which is therefore movable downwardly in the direction of the arrow, as viewed in FIG. 2, simultaneously with the downward movement of the upper die member 22.

The operation of the progressive die machine 20 to form the workpiece 12 can best be described by referring to both FIGS. 1 and 2. A continuous strip of sheet metal 40 from which the workpiece 12 is to be formed is progressively fed into the die machine 20 from left to right in the direction of the arrow F, as viewed in FIGS. 1 and 2. In a first forming stage 42, the upper die member 22 is moved downward so that a first die or punch (not shown) forms the central circular opening 14 and the radially inwardly extending tongue 16 of the workpiece 12. In the same first forming stage 42, two laterally spaced punches (not shown) form two laterally spaced pilot holes 44 in the strip of sheet metal 40 in response to the downward movement of the upper die member 22. These laterally spaced pilot holes 44 provide means for properly locating the formed portion of the workpiece 12 in each of the subsequent forming stages of the die machine 20 by using locator pins 34 to assure proper orientation of the formed workpiece relative to other dies or punches 26.

From the first forming stage 42, the portion of the sheet metal operated on in the first stage 42 is moved forward to a second forming stage 46. Here, a first set of locator pins 34 and a second die or punch 26 are moved downward in response to movement of the upper die member 22 to simultaneously engage the previously formed pilot holes 44 to assure proper location of the previously formed portion of the workpiece 12 within the second forming stage 46 and bend the tongue 16 to project a portion of it axially outward. While the portion of the tongue 16 is being bent axially outward in the second forming stage 46, another inner circular opening 14 and radially inwardly projecting tongue 16 are simultaneously being formed in the first forming stage 42 when the upper die member 22 is moved downward.

In a third forming stage 48, a second set of locator pins (not shown) and a third die or punch (not shown) are moved downward in response to movement of the upper die members 22 to simultaneously locate the previously formed portion of the workpiece 12 within the third forming stage 48, form the outer circular periphery 18 of the workpiece 12, and punch out the formed washer 12, as shown in FIG. 4. Again, the forming steps occur simultaneously in the first, second, and third stages 42, 46, 48 as the strip of sheet metal 40 is progressively fed through the die machine 20.

In a fourth forming stage 50, as can best be seen in FIG. 1, a third set of locator pins (not shown) and a fourth die or cut-off tool (not shown) are moved downward in response to movement of the upper die member 22 to locate and remove the scrap portion of the strip of sheet metal 40 by cutting along a line, such as the dotted line 52. The fourth forming stage 50 also takes place simultaneously with the first, second, and third forming stages 42, 46, 48 as the strip of sheet material 40 is progressively fed through the die machine 20.

Referring now to FIGS. 2 and 3, a hydraulically controlled locator or pilot pin assembly 60 for supporting the locator pin 34 is mounted in the upper die member 22 and is reciprocally movable with the upper die member 22. The assembly 60 includes a carriage for supporting the locator pin 34 so that such pin is movable relative to and independent of the upper die member 22 of the die machine 20. The carriage includes a lower housing section 62, an intermediate housing section 64, and an upper housing section 66 which are interconnected by threads 68 in sealing relationship using resilient O-rings 69.

The lower housing section 62 of the carriage includes a bore 70 for slidably receiving the locator pin 34. Provided in the lower housing section 62 and engaging the periphery of the locator pin 34 as it slidably moves in the bore 70 is a resilient seal 72. The locator pin 34 includes an enlarged head 74 which is movable within a hydraulic fluid chamber 76 formed by the lower housing section 62 and the intermediate housing section 64 of the carriage. The head 74 of the locator pin 34 engages a ledge 78 separating the bore 70 from the hydraulic fluid chamber 76 to retain the pin 34 within the carriage and locate the pin in its normal projected position, as shown in FIG. 2. The hydraulic fluid chamber 76 contains an incompressible hydraulic fluid such as, for example, oil, which completely fills the first chamber 76. Any retraction movement of the locator pin 34 will necessarily displace such fluid from the chamber 76, and if such displacement is prevented, the fluid will hold the pin in its projected position, as shown, and will oppose movement of the locator pin 34 relative to the lower housing section 62 of the carriage. As will become apparent from a description of the intermediate housing section 64 of the carriage, the locator pin 34 in combination with the first fluid chamber 76 generally forms a hydraulic fluid piston and cylinder mechanism wherein the locator pin 34 is the piston and the hydraulic fluid chamber 76 is the cylinder.

The intermediate housing section 64 and the upper housing section 66 of the carriage form a fluid-receiving chamber 90 which contains a compressible gas 92, such as, for example, air, which is pressurized within the receiving chamber 90. In the illustrative embodiment, the air pressure in the receiving chamber 90 is approximately 100 psi. The hydraulic fluid chamber 76 and receiving chamber 90 are interconnected by a fluid outlet passageway or port 94 which is normally closed by a first unidirectional valve 95. The valve 95 includes a plug 96 which is normally biased toward and seated against a seat surrounding the passageway 94 under the pressure of a relatively heavy compression spring 98 which is retained between the valve 95 and a portion of the upper housing section 66. The valve 95 will only open in response to sufficient pressure, for example, 1,500 psi, applied by the hydraulic fluid 80 in the hydraulic fluid chamber 76 against the plug 96 to compress the compression spring 98.

The intermediate housing section 64 further includes a fluid inlet passageway or port 100 for bypassing the fluid outlet passageway 94. The fluid inlet passageway 100 is normally closed by a second unidirectional check valve 102 which includes a spherical member 104 which is normally biased against a seat in the fluid inlet passageway 100 by a relatively light compression spring 106 retained within the check valve 102.

The check valve 102 closes in the direction of flow from the hydraulic chamber 76 to the receiving chamber 90 so that any hydraulic flow in that direction must pass through the fluid outlet port 94 and will be controlled by the strongly biased valve plug 96. On the other hand, the bypass check valve 102 will open freely when the pressure in the receiving chamber 90 exceeds that in the hydraulic chamber 76 so as to permit hydraulic fluid 80 displaced from the hydraulic chamber 76 to return thereto under the gas 92 pressure when the displacing force on the pilot pin 34 is removed, and thereby to return the pin to its projected position.

The upper housing section 66 of the carriage includes a fluid intake passageway or port 110 which is normally closed by a third unidirectional check valve 112. The third check valve 112 includes a spherical member 114 which is normally biased against a seat in the intake passageway 110 by a relatively light compression spring 116. The fluid intake passageway 110 provides means for charging the receiving chamber 90 with gas 92 under pressure.

In the operation of the assembly 60, if the strip of sheet metal 40 should become misaligned in any one of the four successive forming stages 10 of the progressive die machine 20 so that the locator pin 34 engages the sheet metal 40 when the upper die member 22 is moved downward in the direction of the arrow, as viewed in FIG. 2, a force opposed to the downward movement of the upper die member 22 will be applied to the locator pin 34. Accordingly, unless the locator pin 34 is capable of retracting or collapsing within the upper die member 22, serious damage will occur to either the locator pin 34 or the die machine 20. According to the present invention, trapped hydraulic fluid 80 in the hydraulic chamber 76 initially opposes retraction. When an opposing force of sufficient magnitude is applied to the locator pin 34, locator pin 34 will begin to retract and displace hydraulic fluid 80 into the receiving chamber 90. In order for the locator pin 34 to retract, the magnitude of the opposing force must be sufficient to overcome the biasing force of the compression spring 98 and open the valve 95.

The biasing force applied to the valve 95 depends almost entirely upon the strength of the heavy compression spring 98 in holding the plug 96 in seating relationship to the fluid outlet passageway 94 and is to only a minor and indirect extent affected by the pressurized gas 92. Furthermore, it should be noted that when the locator pin 34 is fully projected and the hydraulic fluid chamber 76 is filled with the hydraulic fluid 80, the receiving chamber 90 also includes a small quantity of the hydraulic fluid 80' sufficient to cover the inlet to the bypass passageway 100. When a sufficient force has been applied to the locator pin 34 to overcome the biasing force of the compression spring 98, the first valve 95 opens and a quantity of the hydraulic fluid 80 is displaced into the receiving chamber 90 to allow the locator pin 34 to retract or collapse within the carriage.

When the upper die member 22 is moved upward so that the force applied to the locator pin 34 is decreased and eventually removed, the fluid pressure in the hydraulic chamber 76 is decreased and the valve 95 closes the fluid outlet passageway 94. In turn, the hydraulic and gas fluid 80, 92, respectively, in the receiving chamber 90 will be sufficiently pressurized to open the second check valve 102 and cause the displaced quantity of the hydraulic fluid 80 to return through the fluid inlet passageway 100 and again fill the hydraulic fluid chamber 76.

One feature of the hydraulic controlled assembly 60 of the present invention which represents an advantage over other collapsible or retractable locator pins is that the use of fluids in the manner described resists collapsing or retracting of the locator pin 34 until the force applied to the locator pin 34 is great enough to produce a fluid pressure within the hydraulic fluid chamber 76 to overcome the biasing force of the compression spring 98. Furthermore, when the fluid pressure in the hydraulic chamber 76 is great enough to overcome the biasing force of the compression spring 98 so that the valve 95 opens, there is an immediate release of fluid pressure within the hydraulic chamber 76 which allows the locator pin 34 to quickly retract or collapse within the carriage of the assembly 60 with the exertion of force against the locator pin 34 which does not progressively increase as is the case with conventional spring-biased locator pins in which the biasing spring progressively increases its opposing force as it is compressed by retraction of the pilot pin.

What is claimed is:

1. A pilot mechanism for sensing the proper condition of a workpiece in a machine having a first element movable toward and away from a second element in operations on a workpiece disposed therebetween, comprising a pilot pin mounted in the first element and having a normal projected position from which it is retractable when a force opposed to the movement of said element is applied to the pin, a hydraulic chamber from which hydraulic fluid is displaced in response to such retraction movement of the pin, means for preventing displacement of hydraulic fluid from such chamber at a pressure in such fluid below a predetermined high pressure so as to prevent such retraction movement under a retraction force on the pin below a corresponding high force, and for releasing hydraulic fluid from the chamber under a higher pressure produced by a higher retraction force.

2. The pilot mechanism as recited in claim 1 with the addition of a receiving chamber to which hydraulic fluid is displaced by retraction of the pin under such higher retraction force, and means for returning said displaced hydraulic fluid to said hydraulic chamber, said receiving chamber being charged with compressible gas at a relatively low pressure sufficient to return hydraulic fluid to the hydraulic chamber when the retraction force is removed.

3. The pilot mechanism as recited in claim 2 wherein the means for preventing displacement and releasing the hydraulic fluid includes a main valve closing against flow and strongly biased to a closed position, and the means for returning the hydraulic fluid includes a bypass valve adapted to open under said relatively low fluid-return pressure.

4. A pilot-pin mounting for a die set, comprising a pilot pin and means for mounting it in one die member for guiding entry into a previously formed hole in a workpiece or in a companion die member as the die members are moved toward each other, the pin being axially retractable in its mounting in the event it strikes an obstruction, a hydraulic chamber formed behind the pin into which the pin moves in such retraction to displace hydraulic fluid therefrom, a relief chamber communicating with said hydraulic chamber through a restricted valve port, a pressure-relief valve closing against flow of hydraulic fluid from said hydraulic chamber to said relief chamber and biasing means strongly opposing opening of said relief valve so as to prevent displacement of fluid therefrom at fluid pressures below a relatively high pressure and thereby oppose pin retraction in normal operation, a bypass valve in parallel with said relief valve opening with flow from said relief chamber to said hydraulic chamber for returning to the hydraulic chamber hydraulic fluid displaced by the retraction of the pin into such chamber, and means to charge the relief chamber with compressible gas at a relatively low pressure sufficient to return displaced hydraulic fluid therefrom to the hydraulic chamber and thereby to drive the pilot pin to its normal position when retraction force is removed from the pin.

5. An assembly for locating a workpiece in a punch press where the workpiece is progressively moved through successive forming stages of the press, comprising a movable die, a locator pin for engaging pilot holes formed in the workpiece in response to movement of the movable die, means for supporting the locator pin in the movable die to allow retraction movement of the pin relative to the die, and hydraulic means for controlling the retraction movement of the locator pin relative to the movable die, the hydraulic control means including a first chamber into which the pin retracts, said chamber containing hydraulic fluid to normally oppose retraction movement of the locator pin relative to the movable die, a second chamber containing a compressible gas, means for interconnecting the first and second chambers to allow the fluid to flow therebetween, and valve means cooperating with the interconnecting means to normally prevent flow of fluid from the first chamber but to allow the fluid to flow into the second chamber when an excessive force is applied to the locator pin in opposition to movement of the movable die, said valve means also including means to allow a displaced quantity of the fluid to flow back into the first chamber when the force applied to the locator pin decreases.

6. In a progressive punch press of the type which includes at least one movable ram supporting a plurality of die elements for forming a workpiece from a strip of sheet material in successive forming stages as the sheet material is fed through the press, and a pilot pin movable with the ram for engaging a pilot hole formed in the sheet material to properly locate the sheet material within the press during a forming stage, the improvement comprising a hydraulic assembly including a chamber filled with hydraulic fluid for maintaining said pilot pin in projected position and against retraction by forces occurring in normal operation of the press, and means to release from said chamber fluid displaced therefrom in response to retraction of the pilot pin under excessive force imposed thereon by an abnormal obstruction to its movement with the movable ram.

7. The improvement as recited in claim 6 wherein the assembly includes a piston and cylinder mechanism, the piston being connected for movement with the pilot pin and the cylinder including a fluid inlet valve and an outlet valve which normally prevents escape of fluid from the cylinder, said outlet valve permitting such escape at a predetermined high pressure in the fluid.

8. The improvement as recited in claim 7 wherein the assembly further includes a receiving chamber communicating with the fluid inlet and outlet valves of the cylinder, said valves each being a normally closed unidirectional valve, the cylinder containing a hydraulic fluid, and the receiving chamber containing a compressible gas.

9. The improvement as recited in claim 8 wherein the normally closed outlet valve is opened to allow displacement of the hydraulic fluid into the receiving chamber in response to pressure in the cylinder when the excessive force is applied to the locator pin and the normally closed inlet valve is opened to allow the displaced hydraulic fluid to return to the cylinder in response to gas pressure on the displaced hydraulic fluid in the receiving chamber as the excessive force applied to the locator pin decreases.

10. A method of controlling retraction movement of a normally projected locator pin in a machine in response to opposition to its normal movement for engaging pilot holes in a workpiece, comprising the steps of opposing retraction movement of the locator pin by hydraulic fluid contained in a hydraulic chamber, displacing hydraulic fluid from the hydraulic chamber in response to a high pressure in the hydraulic fluid sufficient to open a first normally closed valve so as to allow the locator pin to retract in response to an external force applied to the locator pin in opposition to its normal movement, containing the displaced hydraulic fluid in a receiving chamber, and returning the displaced fluid to the hydraulic chamber by applying sufficient pressure to the displaced hydraulic fluid in the receiving chamber to open a second normally closed valve when the external force applied to the locator pin decreases.

11. The method as recited in claim 10 wherein sufficient pressure is applied to the displaced hydraulic fluid in the receiving chamber by compressing a compressible gas contained in the receiving chamber.

12. Pilot pin mechanism for a progressive die machine having a movable first die movable toward a second die in successive strokes to operate in successive stages on a workpiece moved through the machine in successive steps, comprising a pilot pin normally projecting from the first die toward the second die and movable with the first die to enter a pilot hole in a properly located workpiece, a displacement chamber into which the pilot pin is retractable in the event it is obstructed from normal movement with the first die, hydraulic liquid filling said chamber and means to prevent escape of such liquid from the chamber at hydraulic pressures below a predetermined high pressure so as to oppose retraction of the pin under retraction forces below a corresponding high retraction force, a collection chamber for receiving hydraulic liquid displaced from said displacement chamber under said high pressure, and means for returning the displaced liquid from the collection chamber to the displacement chamber when the high retraction force is removed from the pilot pin and the pin returns to its normal projected position, said pin being biased to its normal position by a relatively low force sufficient to return the pin to its normal projected position when the high retraction force is removed.

13. Pilot pin mechanism as in claim 12 in which said means to prevent escape of hydraulic liquid from said displacement chamber comprises a unidirectional valve closing against flow of liquid from such chamber and strongly biased to closed position.

* * * * *